US005127044A

United States Patent [19]

Bonito et al.

[11] Patent Number: 5,127,044

[45] Date of Patent: Jun. 30, 1992

[54] AUTOMATIC GOLF SCORING AND SCHEDULING SYSTEM

[75] Inventors: Anthony Bonito, Davie; Michael Appelton, Lauderdale Lakes, both of Fla.

[73] Assignee: Golf Scoring Systems Unlimited, Inc., Plantation, Fla.

[21] Appl. No.: 481,212

[22] Filed: Feb. 20, 1990

[51] Int. Cl.[5] ..... A63B 71/06; G06F 15/44; G08B 7/06; H04M 11/00

[52] U.S. Cl. ..... 379/88; 235/375; 273/176 L; 340/323 R; 364/411; 377/5; 379/104

[58] Field of Search ..... 379/104, 105, 106, 88, 379/97, 98; 364/411; 235/375; 377/5; 340/323 R; 273/176 AB, 176 L

[56] References Cited

U.S. PATENT DOCUMENTS

| | | | |
|---|---|---|---|
| 3,898,437 | 8/1975 | Butler | 235/95 R |
| 4,192,510 | 3/1980 | Miller | 273/176 A |
| 4,266,214 | 5/1981 | Peters | 340/323 R |
| 4,268,744 | 5/1981 | McGeary | 235/375 |
| 4,367,526 | 1/1983 | McGeary et al. | 364/411 |
| 4,419,655 | 12/1983 | May | 340/323 R |
| 4,480,310 | 10/1984 | Alvarez | 364/450 |
| 4,783,800 | 11/1988 | Levine | 379/67 |
| 4,910,677 | 3/1990 | Remedio et al. | 364/410 |

OTHER PUBLICATIONS

"Voice Response System and Its Applications", Y. Ozawa et al., *Hitachi Review*, vol. 28 (1979), No. 6, pp. 301-305.

*Primary Examiner*—Thomas W. Brown
*Attorney, Agent, or Firm*—Oltman and Flynn

[57] ABSTRACT

An electronic golf scoring system which includes a scoring subsystem installed for example in a golf cart or carried manually on the golf course; a handicap subsystem installed for example in a fixed location, e.g. in a clubhouse or the like; a portable data memory device that serves for transferring data between the scoring subsystem and the handicap subsystem; some interface or means for reading data into and out of the memory device connected to and being part of both the scoring subsystem and the handicap subsystem, wherein the data includes player identification data identifying each player preparing to play a round of golf and golf course pictorial data which serve to provide pictorial features of the chosen golf course, and other data as may be useful to the players. In accordance with still another feature there is provided an electronic golf cart scoring system, which includes a data memory connected to the handicap processing unit for storing data, including data representing pictorial features of a golf course.

13 Claims, 5 Drawing Sheets

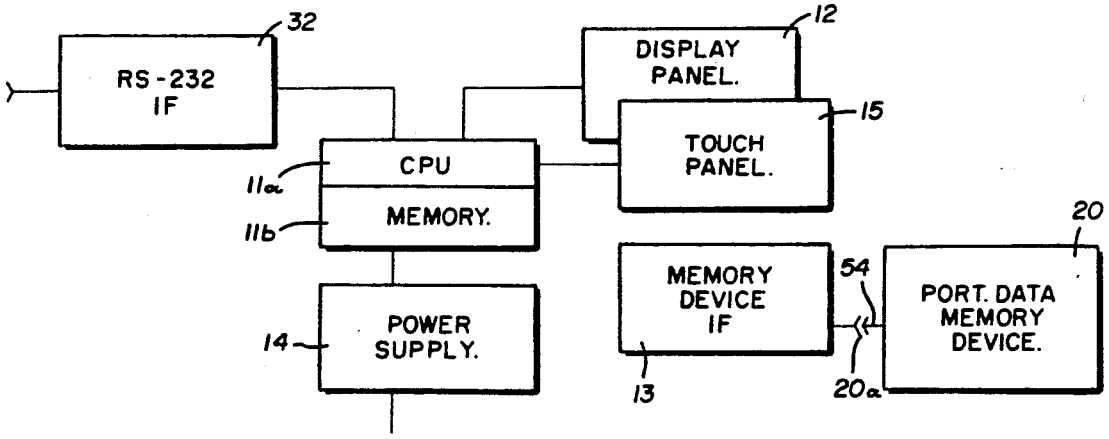
FIG. 1
FIG. 2
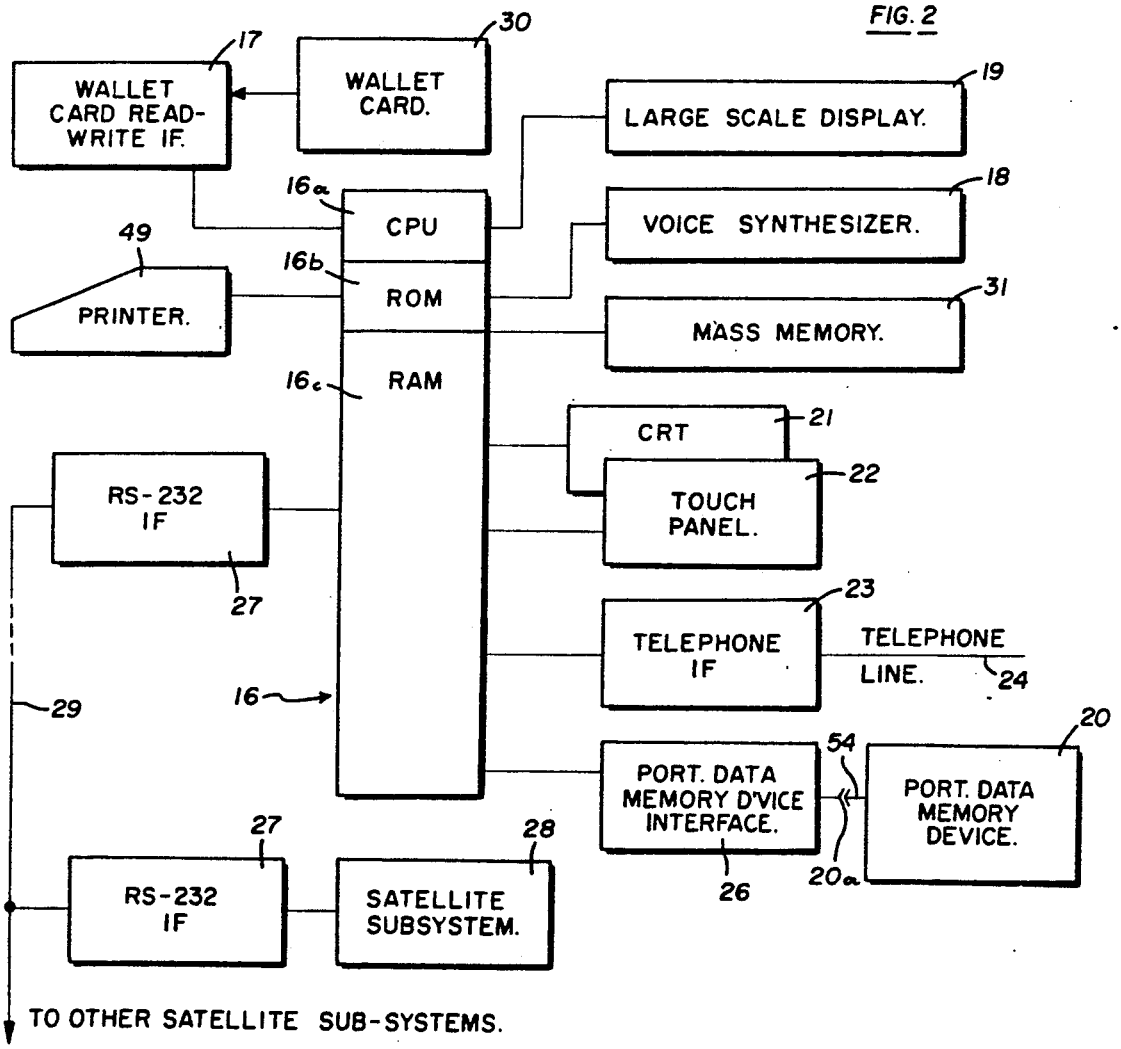

AUTOMATIC GOLF SCORING AND SCHEDULING SYSTEM

The invention relates to a system for electronically performing the task of scoring and processing of golf scores and for electronically scheduling of tee times.

BACKGROUND AND PRIOR ART

In golf clubs, especially larger golf clubs with many members and several courses, the task of recording and keeping scores for the members including computing handicaps, scheduling tee times, recording fees for using the clubs facilities and so forth may require considerable effort in terms of manpower and is, when performed manually, prone to mistakes and human errors. Before playing, a golfer typically will schedule a tee time in advance to assure his position in a starting queue which is a list maintained manually by a pro-shop operator. Before play actually begins, the golfer(s) must remit any fees associated with use of course facilities. At this time the golfer is given a scorecard used to manually record his scores during actual play. Information unique to the golf course is pre-printed on the scorecard. This may include rules, etiquette, numerical data regarding the difficulty of the course and each individual hole, and a graphical map of the course depicting obstacles and hazards in a symbolic form.

Next, the golfer plays the round, recording his strokes as he completes each hole. The actual score he records is modified by an assigned handicap which is computed by the club and based on the golfer's previous scores.

Upon completion of the round, the golfer returns the completed scorecard to a pro shop with his name or ID code attached. The scorecards for all members of the club are retained for some fixed period of time unique to the club. At the end of this period, the scores for members and a handicap are statistically processed using one of several algorithms prevalent in the golfing industry. The algorithm is either performed by hand or the scores are manually transcribed into a computer system which implements the algorithm. The number of collected scores for a club can reach over 100,000 in a year. Manual processing is therefore tedious. The purpose of the processing is primarily to assign each golfer a handicap, which normalizes the abilities of golfers in competitive play and the differences in difficulty between various golf courses.

The club will usually post the results of the handicap process for the entire membership in printed form at some prominent location in the clubhouse. Additionally, each member is given a wallet sized card showing the results of the handicap process. This is shown as a voucher of the golfer's playing ability when he plays at a course other than his home course.

Before playing, golf players often call the club's pro shop to schedule a playing time for a preferred course. Such scheduling also requires manpower and is also prone to mistakes and human errors.

In the past, attempts have been made to facilitate the process of scoring various games by electronic means, and other aspects of the golf game. U.S. Pat. No. 4,266,214 shows an electronically operable game scoring apparatus. U.S. Pat. No. 4,480,310 shows an electronic system for golf course range-finding by means of a computer installed in a golf cart. U.S. Pat. No. 4,419,655 shows a golf course play indicator which includes pictorial graphics of a golf course, and U.S. Pat. No. 4,367,526 shows a golf calculator for computing scores.

None of the prior art, however, has solved the problem of providing an electronic scoring system that overcomes problems inherent in performing scoring and record keeping by manual means.

SUMMARY OF THE INVENTION

It is a primary object of the instant invention to provide electronic means to the game of golf for facilitating the various tasks of score keeping, computing handicaps, keeping player records and so forth.

It is a further object to use the aforesaid means to enhance the pleasure of the game by making golf course features electronically available to a player during the game play by means of an electronic pictorial display installed in the golf cart as carried by the player.

There is, in accordance with the instant invention, provided an electronic golf scoring system which includes:

a. a scoring subsystem installed for example in a golf cart or carried manually on the golf course;
b. a handicap subsystem installed for example in a fixed location, e.g. in a clubhouse or the like;
c. a portable data memory device that serves for transferring data between the scoring subsystem and the handicap subsystem;
d. some interface or means for reading data into and out of the memory device connected to and being part of both the scoring subsystem and the handicap subsystem, wherein the data includes player identification data identifying each player preparing to play a round of golf and golf course pictorial data which serve to provide pictorial features of the chosen golf course, and other data as may be useful to the players.

In accordance with still another feature there is provided an electronic golf cart scoring system, according to the invention which includes a data memory connected to the handicap processing unit for storing data, including data representing pictorial features of a golf course.

The invention may optionally further include means for zooming the pictorial features, and manual control means for manually controlling the zooming means.

The electronic golf scoring system according to the invention may include an electric power supply for supplying electric power to the scoring subsystem, said electric power supply having a power input connected to an electric system for powering the golf cart.

The electronic golf scoring system according to the invention, wherein the handicap subsystem includes a central processing unit, a display matrix connected to the central processing unit, and a touch panel overlaid on the display matrix for manually entering data to the central scoring subsystem, and wherein the display matrix includes a cathode ray tube.

According to a still further feature, the electronic handicap subsystem includes a central processing unit, and memory for storing at least a handicap computing algorithm, score data for golf players and individual data for golf players, and includes a printer for printing contents of the memory.

Optionally, the electronic golf cart scoring system according to the invention includes a voice synthesizer connected to the handicap subsystem, and a telephone line interface for providing interactive voice response with persons calling the telephone line.

Further still, the electronic handicap subsystem may include an electronic leader board connected to the central processing unit for displaying data stored in the memory and the memory may include a program or algorithm for interactively scheduling golf player's tee time via the telephone line.

In addition, a method is disclosed for interactive scheduling tee times for a golf player via a telephone line interface connected to a central processing unit, which has a voice synthesizer, a data memory, and a mass memory connected to the central processing unit. The method comprises the steps of:

a. calling the telephone line interface from a telephone,
b. entering a personal identification number from the telephone,
c. finding, by means of a scheduling program stored in the data memory, a file containing available tee times for a given golf course on a given day,
d. transmitting by means of the voice synthesizer the available tee times, to the telephone line,
e. entering by means of a keypad connected to the telephone a requested tee time, and
f. marking in the file the requested tee time as being unavailable.

Further objects and advantages of this invention will be apparent from the following detailed description of a presently preferred embodiment which is illustrated schematically in the accompanying drawings.

BRIEF DESCRIPTION OF THE FIGURES

FIG. 1 is a block diagram of the invention showing a scoring subsystem for installation in a golf cart or for carrying on a golf course;

FIG. 2 is a block diagram of the invention showing a handicap subsystem;

FIG. 6-B is a view showing a scorecard display.

DESCRIPTION OF THE PREFERRED EMBODIMENTS

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

The scoring system according to the invention provides electronic means for collecting, processing and reporting golf scores. This is accomplished by means of three subsystems working together. The subsystems are designed to replace the manual scoring methods prevalent in the golfing industry at the present time. Operation of the subsystems requires a minimum of technical expertise on the part of the user. The three subsystems include a scoring subsystem, a handicap subsystem and a portable data memory device.

FIG. 1 is a block diagram of the electronic scoring subsystem which will typically be installed in a golf cart, or carried by a person on the golf course during the play. A central processing unit (CPU) 11 is combined with a memory 11*b* for storing control programs, player scores and graphic features of the golf ccourse, and other data.

Figure 6A:
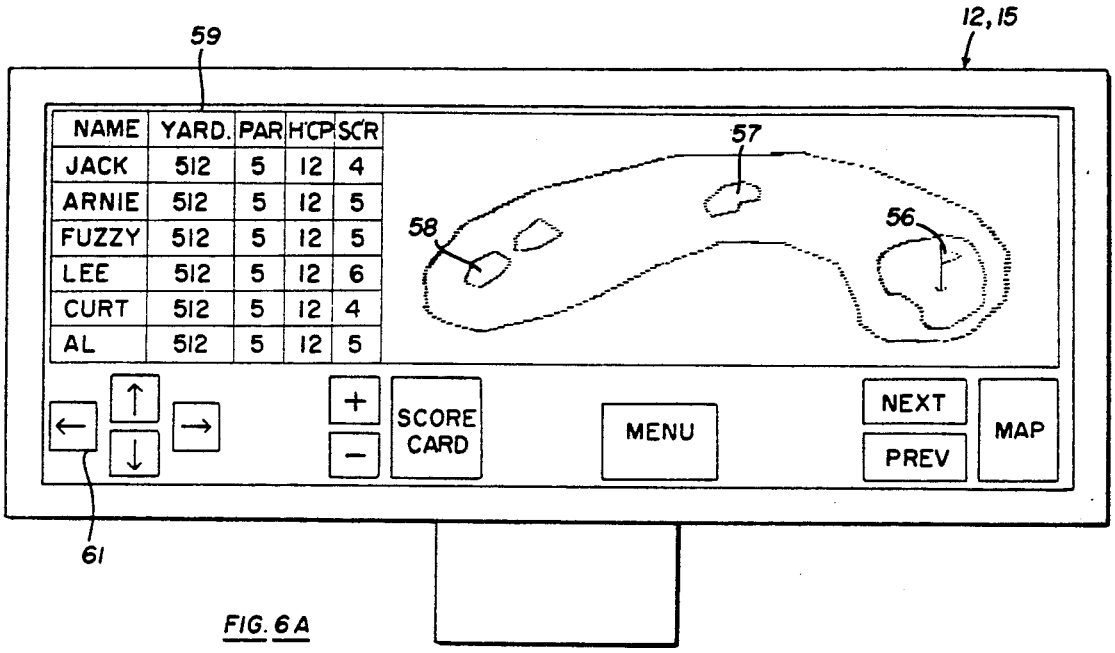
FIG. 6-A is a view showing a graphic feature of a green of a golf course combined with player information.
Figure 6B:
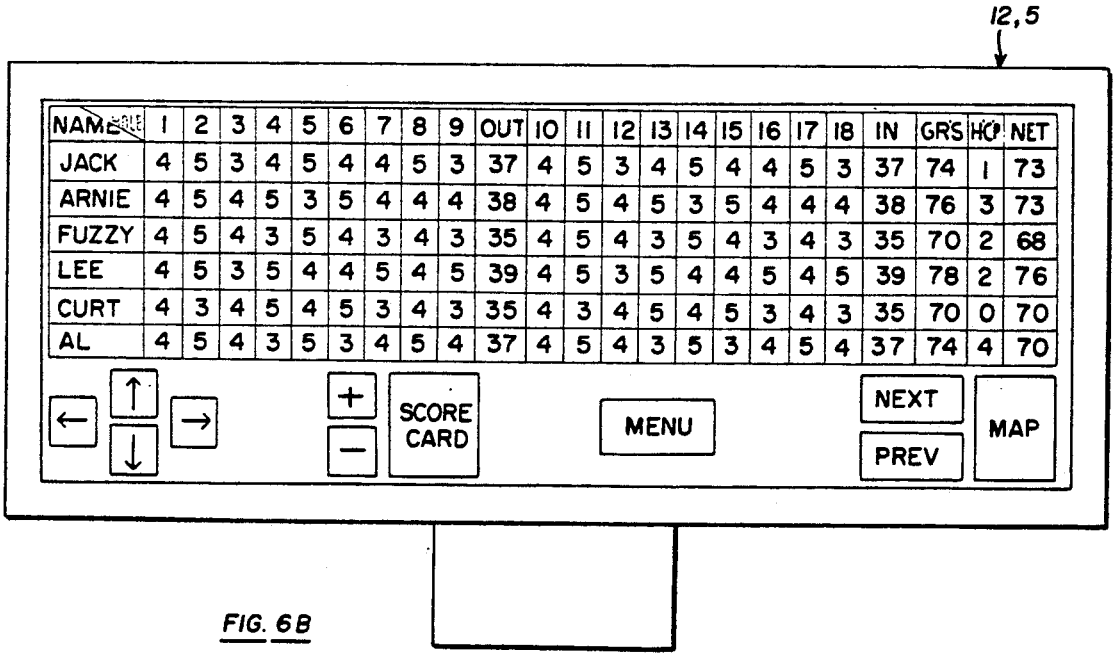

A combined display/touch panel 12,15 serving as an interface with the players, consists of a display panel 12 advantageously in the form of a liquid crystal dot matrix (LCD), and an input panel 15 in the form of a touch panel of conventional construction overlaid on the LCD display. The touch panel 15 typically includes a transparent sheet having printed thereon a matrix of conductive lines, forming a plurality of cross points. Whenever a finger is placed on one of the crosspoints, which are continuously scanned in synchronism with the LCD display, an input signal corresponding to the location of the crosspoint, is entered into the CPU and used for inputting commands and data. In operation the display panel 12 may be displaying a numerical display similar to a conventional keyboard or it may be fitted to the particular application, as shown in FIGS. 6-A & 6-B. Data can be entered by touching the touch panel at an area designated by a letter, word, symbol, label or number displayed by the LCD display under the touch panel. It follows that any other type of display can be used, such as a CRT display, a plasma display or the like.

A memory device interface 13 serves to read and write data on a portable data memory device 20, e.g. in the form of a cartridge containing memory chips or a memory disc with a magnetic coating on it. A blank portable data memory device 20 is issued to one of the players before a round is started, either from a bin of blank devices or from a computer-controlled dispenser, which serves to read into the device the players, names, handicaps, etc and other data as may be pertinent. In addition, each player or club member has a wallet card 30 issued to him, which has on it a magnetic stripe or other machine readable medium on the card on which all pertinent personal data for the player, such as his name, his standing as a club member, e.g. his current handicap, and the like. The wallet card may also have printed thereon in plain printing the same information as stored on the magnetic stripe. The data memory device 20 replaces the conventional printed score card issued to each player before a game.

The memory device 20 is initially blank and must be prepared. This is accomplished by each golfer in the group passing his wallet card 30 through a reader connected to the handicap subsystem, which obtains the data specific to him from the coded magnetic stripe on the wallet card 30. A query and response procedure using data input/display devices 22,21 is provided for those who are not members or do not have the wallet card with them. The golfer(s) also can select which course to play if the club offers multiple courses. Several options related to various techniques of scoring and competition are also provided.

The handicap sub-system analyzes the selected options, golfer personal data and selected course data to determine the scoring subsystem program code requirements for the round to be played. The handicap sub-system then assembles the appropriate scoring subsystem program code from instructions and data maintained on its mass storage 31.

The handicap subsystem then copies the assembled scoring subsystem program into the memory device 20 via the memory device interface 26. The golfer removes the memory device and proceeds to obtain his golf cart.

Once in the golf cart, the player inserts the memory device 20 into the scoring subsystem. The scoring subsystem copies the prepared program code from the memory device into the internal program memory 11*b* via the memory device interface 13. A validation algorithm is performed to insure integrity of the copy of the program code. In case of error the program terminates with appropriate error messages displayed on the scoring subsystem display panel 12.

The scoring subsystem begins execution of the copied program code. The program operates interactively with the golfer by displaying information and registering responses. Two basic modes of interaction are provided.

The first mode displays a graphic facsimile of the standard printed scorecard in the form of a 2-D matrix shown in FIG. 6-B. The course hole numbers are indexes along one axis and golfer names along the other. The entry cell (cursor) position is indicated by reversing and/or blinking the appropriate displayed area. Each player records the strokes taken and "navigates" the entry cell (cursor) around the scorecard by touching keys rendered on the touch screen.

A second mode shown in FIG. 6-A, displays a scaled symbolic graphic representation of the topography of the course being played. Selective "zooming" or modifying the point of view of the displayed image is accomplished by touching appropriate areas of the display touch panel combination 12,15. Since the graphic is scaled, point to point distances can be obtained by touching the appropriate areas on the display, obtaining the scaled co-ordinates of the physical locations represented by the touched positions, and using simple trigonometry algorithms stored in the memory 11*b* to calculate and display the distance.

The golfer is free to select between the two modes during the game and competitive standings are available at all times.

When all holes are played, the results of the game are copied back into the memory device 20 by way of the memory device interface 13. At the end of the round the memory device 20 is removed from the scoring subsystem and inserted into the memory device interface 26 for transfer of the score data to the handicap subsystem.

The pictorial features of the golf course are, as mentioned above, stored as pictorial data in the memory 11*b* of the scoring subsystem. The pictorial data may alternatively be entered into the scoring subsystem in other ways, for example by connecting the CPU/Memory 11*a,b* via a data interface 32, e.g. a so-called RS-232 interface, which in turn communicates with the mass memory 31 of the handicap subsystem at the clubhouse. The RS-232 interface may also be used to perform diagnostic tests on the scoring subsystem, including the golf cart.

FIG. 2 is a block diagram of the handicap subsystem, which is typically centrally located, e.g. in the club house or the pro-shop or other fixed location. The handicap subsystem includes a CPU/memory 16 which is connected to various peripheral systems, including a wallet card read/write unit 17, a voice synthesizer 18 which, under control of input commands from the CPU/Memory 16 forms spoken words, a large scale display 19 which can be used e.g. as a leader board or the like positioned conspicuously in the club house, a CRT display 21, an input device 22 which can be a touch panel as described for the scoring subsystem or a conventional keyboard, a telephone line interface 23 connected to one or more telephone lines 24, a mass memory 31, which may advantageously be a disk storage, and a wallet card read/write unit 17 for exchanging player data with the players' or members' wallet card, as is well known from magnetic card read/write systems. A serial data interface 27, advantageously in the form of an RS-232 interface, may provide data communication with other fixed subsystems, shown as a satellite subsystem 28, located for example in a pro shop.

Figure 3:
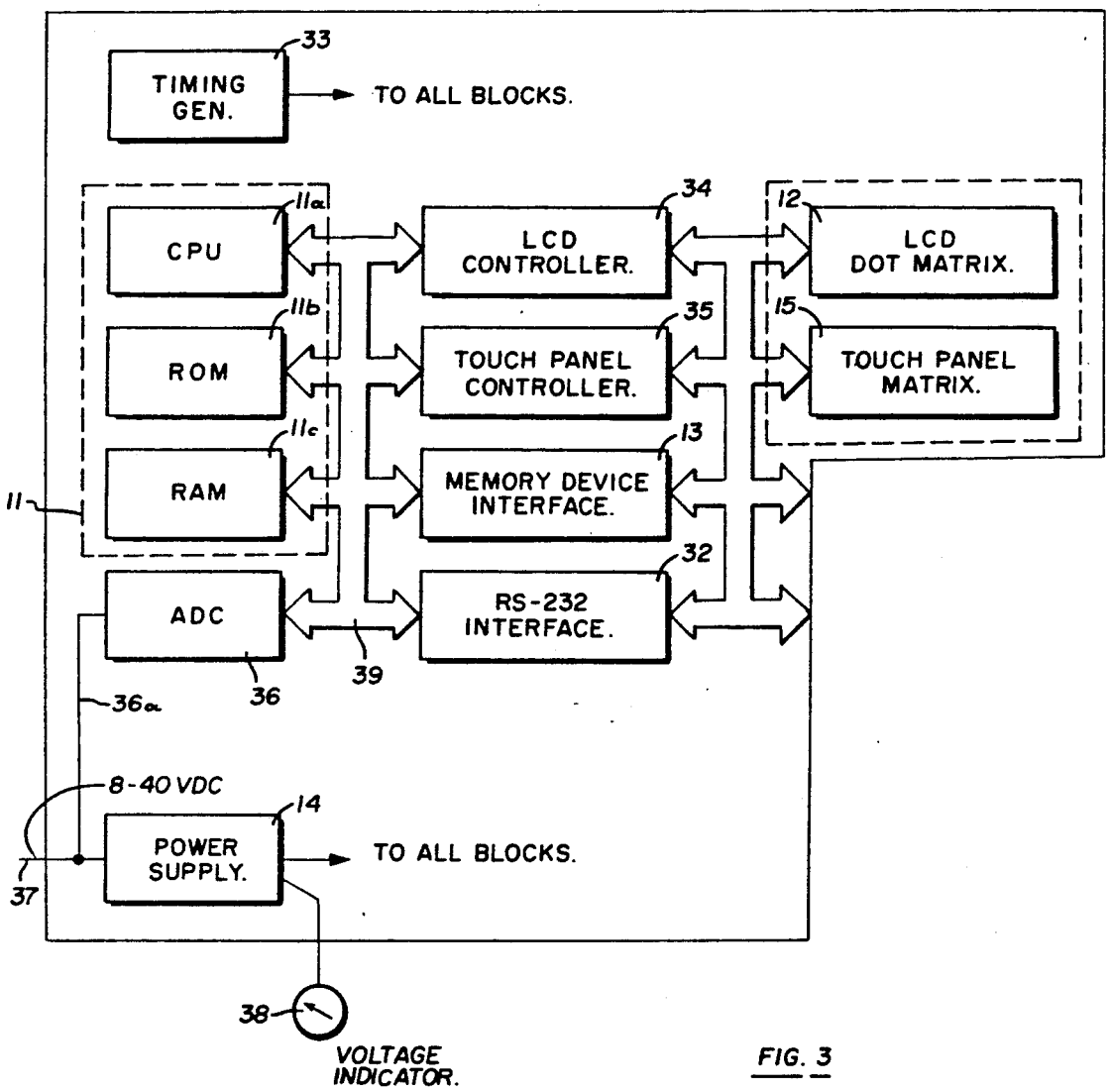
FIG. 3 is a more detailed block diagram showing details of the scoring subsystem.

FIG. 3 shows more details of the scoring subsystem, wherein a timing generator 33 provides timing and clock pulses for the other blocks of the subsystem, a liquid crystal display controller 34 which provides the proper signal levels and timing signals for the liquid crystal dot matrix 12, a touch panel controller 35 which provides the proper signal levels and timing signals for operation of the touch panel 15, an analog/digital converter 36 having it analog input 36*a* connected to the subsystem's primary power bus 37, which enables the CPU 11*a* to test for presence of proper power levels. A voltage indicator 38 may also be provided for manual testing of the prmary power voltage. An internal data bus 39 serves to interconnect all the individual blocks of the scoring subsystem.

Figure 4:
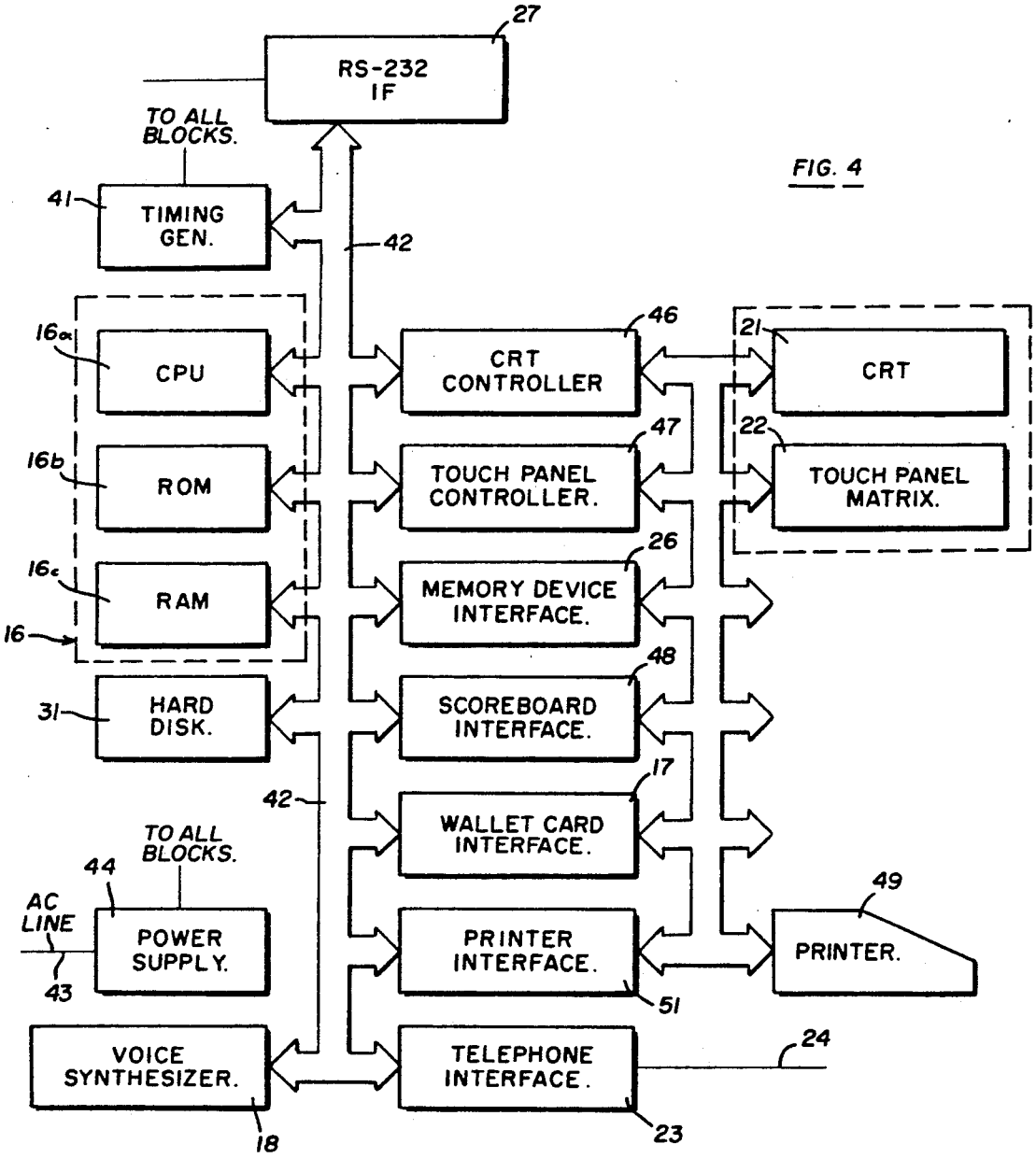
FIG. 4 is a more detailed block diagram of the invention showing details of the handicap subsystem.

FIG. 4 is a more detailed block diagram of the handicap subsystem, wherein a timing generator 41 provides all timing and clock signals required for operation of the individual system blocks, an internal data bus 42 provides data communication between the system blocks, an AC-power line 43 provides primary power for a power supply 44, which in turn supplies power to the subsystem, a CRT controller 46 provides the proper timing and control signals for the CRT display 21, a touch panel controller 47 provides the necessary timing and control signals for the touch panel matrix 22, a scoreboard interface 48 provides proper signal levels and control signals for a large scale display such as a leader board.score board or the like. A printer interface 51 provides the proper timing and control signals to operate a printer 49, and a telephone interface 23 provides the proper control and audio signals to operate one or several telephone lines 24 for communicating with a voice synthesizer 18 and a tee-time scheduling algorithm stored in the memory 16*b* and 16*c*.

Figure 5:
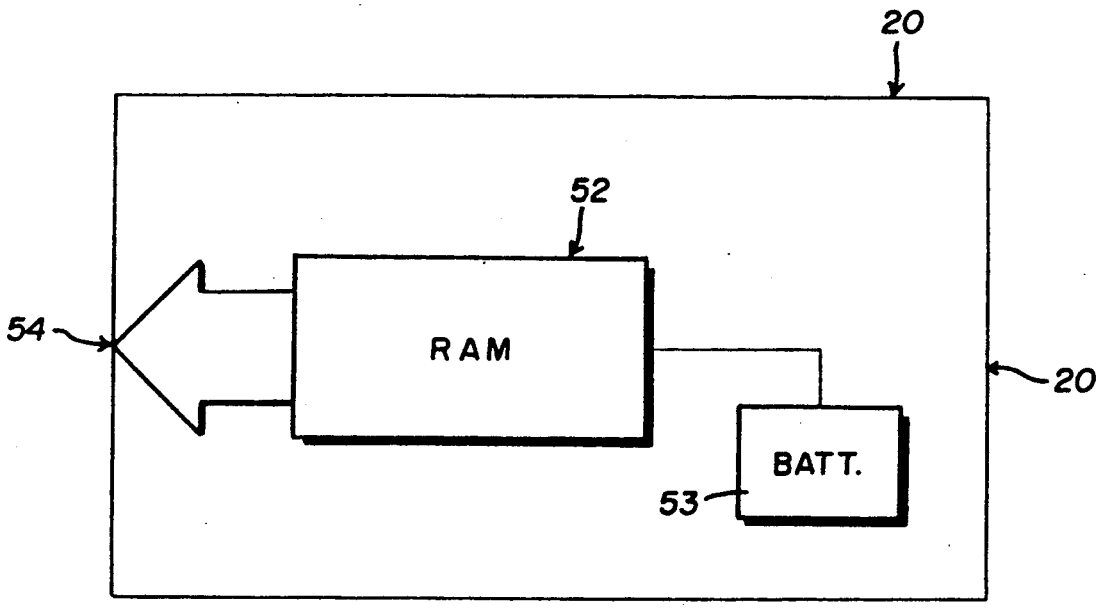
FIG. 5 is a block diagram of the invention showing a portable data memory device.

FIG. 5 is a block diagram of the portable data memory device 20, which advantageously includes a random access memory (RAM) 52, composed for example of a number of solid state memory chips and a battery 53 for supplying the memory 52 with standby power. The RAM 52 is connected to a plug-in connector 54 which mates with a matching connector for the memory device interface 13 of the scoring subsystem and the memory device interface 26 of the handicap subsystem.

FIG. 6-A is a typical view of the liquid crystal dot matrix display panel 12 of the scoring subsystem as it appears in the graphics mode, showing in outline a hole marked with a flag 56, traps 57 and a tee 58. A side panel 59 hows various playing data for the players such as distance, par value, player handicaps and scores. Various keys 61 serve to enter manual control inputs to operate the display and entry of scores.

In order to schedule a tee time from a telephone, a player first dials a telephone number for the telephone line(s) connected to the telephone line interface. When connection is made, the voice synthesizer controlled by the scheduling algorithm issues instructions to the player for first entering from the telephone, by means of the telephone keypad, his personal identification number and a desired tee-time and data, which is stored in a file in memory, after which the voice synthesizer presents, from a file in memory containing available tee times for any given day, an available tee time closest to the desired time, or upon further instructions all available tee times, which allows the caller to enter, again via the keypad, instructions to make a given time unavailable to other callers.

After completing a round of golf, one of the players removes the memory device 20, which now contains the scores of the players, and plugs the memory device into a connector 20*a* of the memory device interface 26 at the handicap subsystem, and the score data are transferred to the mass memory 31 of the handicap subsystem with a key unique to each golfer so that the data may later be retrieved by supplying the unique key.

The results are printed on individual score cards for each player in the printer 49 so that each player may have his own copy. The results may also be displayed on the large scale display 19 so that spectators may be aware of the standings in competitive play.

At any time any member may review his stored scores on the HDCP subsystem. This is accomplished by the member manually entering his unique ID key or by inserting his wallet card.

Periodically, the golf course operator will initiate the handicapping algorithm which is performed for all members of the club. A hardcopy of the algorithm output is printed so that it may be posted in the clubhouse.

We claim:

1. An electronic golf scoring system comprising:

a mobile scoring subsystem, a fixed handicap subsystem, and a portable data memory device for transferring data in said data memory device between said scoring subsystem and said handicap subsystem, respective first and second reading and writing means for reading and writing the data in said portable data memory device in said scoring subsystem and in said handicap subsystem;

a scoring central processing unit in said scoring subsystem, a display panel in said scoring central processing unit for displaying data from said scoring central processing unit, a touch panel overlaid on said display panel in said scoring central processing unit for manually entering data into said scoring central processing unit, and wherein said display panel is a liquid crystal dot matrix.

2. An electronic golf scoring system according to claim 1, including a wallet card issued to each player, having machine readable information on said wallet card, and wallet card reading means in said scoring subsystem and in said handicap subsystem for respectively reading said machine readable information into said handicap subsystem and into said scoring subsystem.

3. An electronic golf scoring system according to claim 1, wherein said portable data memory device operates to store score data and golf course pictorial data.

4. An electronic golf scoring system according to claim 3, including zooming means in said scoring subsystem for zooming said pictorial data, and manual control means in said zooming means for manually controlling said zooming means.

5. An electronic golf scoring system according to claim 1, including a handicap central processing unit in said fixed handicap subsystem, a further display panel in said handicap subsystem, and a further touch panel overlaid on said further display panel for respectively reading data from and entering data into said handicap subsystem.

6. An electronic golf scoring system according to claim 5, wherein said further display panel includes a cathode ray tube.

7. An electronic golf scoring system according to claim 5, including memory means in said handicap central processing unit for storing at least a handicap computing algorithm, score data for golf players and individual data for golf players.

8. An electronic golf scoring system according to claim 7, including a printer in said handicap central processing unit for printing contents of said memory means.

9. An electronic golf scoring system according to claim 8, including a voice synthesizer in said handicap central processing unit, and a telephone line interface in said handicap central processing unit for providing interactive voice response with persons calling said telephone line interface.

10. An electronic golf scoring system according to claim 7, including an electronic leader board connected to said handicap central processing unit for displaying data stored in said memory means.

11. An electronic golf scoring system according to claim 9, including an algorithm stored in said memory means for interactively scheduling each golf player's tee time via said telephone line interface.

12. An electronic golf scoring system according to claim 1, wherein said portable data memory device includes a solid state memory, a standby power source connected to said solid state memory and a plug-in connector connected to said solid state memory for detachably connecting said portable data memory device with one of said scoring subsystem and said handicap subsystem.

13. An electronic golf scoring system according to claim 1, including a printer in said handicap subsystem for printing data stored in said handicap subsystem.

* * * * *